US010265824B2

(12) United States Patent
Xue et al.

(10) Patent No.: US 10,265,824 B2
(45) Date of Patent: Apr. 23, 2019

(54) EXCHANGING DOUBLE-STATION WHEEL BURR REMOVING DEVICE

(71) Applicant: CITIC Dicastal CO., LTD, Qinhuangdao (CN)

(72) Inventors: Bowen Xue, Qinhuangdao (CN); Haipeng Feng, Qinhuangdao (CN); Huayou Li, Qinhuangdao (CN); Zhanku Wang, Qinhuangdao (CN); Jiandong Guo, Qinhuangdao (CN); Changcun Xiao, Qinhuangdao (CN)

(73) Assignee: CITIC DICASTAL CO., LTD (CN)

( * ) Notice: Subject to any disclaimer, the term of this patent is extended or adjusted under 35 U.S.C. 154(b) by 0 days.

(21) Appl. No.: 15/692,464

(22) Filed: Aug. 31, 2017

(65) Prior Publication Data

US 2018/0333821 A1 Nov. 22, 2018

(30) Foreign Application Priority Data

May 19, 2017 (CN) ..... 2017 1 0357517

(51) Int. Cl.

| | |
|---|---|
| ***B24B 41/06*** | (2012.01) |
| ***B24B 47/12*** | (2006.01) |
| ***B24B 9/04*** | (2006.01) |
| ***B24B 19/28*** | (2006.01) |
| ***B24B 5/44*** | (2006.01) |
| ***B24B 9/00*** | (2006.01) |

(52) U.S. Cl.

CPC ..... *B24B 9/005* (2013.01); *B24B 5/44* (2013.01); *B24B 9/04* (2013.01); *B24B 19/28* (2013.01); *B24B 41/06* (2013.01); *B24B 47/12* (2013.01)

(58) Field of Classification Search

CPC .. B24B 9/005; B24B 9/02; B24B 9/04; B24B 5/44; B24B 19/00; B24B 19/28; B24B 41/06; B24B 47/12

USPC ..... 451/231

See application file for complete search history.

(56) References Cited

U.S. PATENT DOCUMENTS

| | | | | |
|---|---|---|---|---|
| 3,258,804 A * | 7/1966 | Fowle | B24B 5/225 15/104.011 |
| 4,216,560 A * | 8/1980 | Schmidt | B24B 41/06 15/268 |
| 2013/0102233 A1* | 4/2013 | Cheon | B24B 27/033 451/331 |

FOREIGN PATENT DOCUMENTS

| | | |
|---|---|---|
| JP | 3044289 B2 * | 5/2000 |
| JP | 3091417 B2 * | 9/2000 |

* cited by examiner

*Primary Examiner* — Eileen P Morgan

(74) *Attorney, Agent, or Firm* — Calfee, Halter & Griswold LLP

(57) ABSTRACT

The present application discloses an exchanging double-station wheel burr removing device, comprising an exchange system, a left burr brushing system, clamping drive systems, a right burr brushing system. In practical use, the four V-shaped rollers lamp a wheel, the first servo motor drives the clamped wheel to rotate, and simultaneously, clamping drive system enables a right wheel to rotate; the drive motor drives the round brush and the outer ring brush to rotate; the first cylinders drive the rotating brushes to ascend, and the brushes in contact with the back cavity of the wheel can remove burrs; the first and second servo electric cylinder can drive the large brush to move, when the large brush are in contact with roots and corners of wheel flanges and rims, it can remove burrs; and the second servo motor can exchange the left burr brushing system with the right burr brushing system.

1 Claim, 3 Drawing Sheets

EXCHANGING DOUBLE-STATION WHEEL BURR REMOVING DEVICE

CROSS-REFERENCE TO RELATED APPLICATIONS

This application claims priority to Chinese Patent Application No. 201710357517.X, filed on May 19, 2017, which is hereby incorporated by reference in its entirety.

TECHNICAL FIELD

The present application relates to a burr removing device, specifically to an exchanging double-station wheel burr removing device.

BACKGROUND ART

In the production process of an aluminum alloy wheel, removing burrs on a back gravity is a very important procedure, and directly influences the coating yield of subsequent procedures. One traditional burr brusher can only brush wheels of one size, so the efficiency is very low. In addition, a large disc brush directly brushes burrs on the back cavity of the wheel under the action of pressure in the traditional burr brushing manner, and when the angular velocity is constant, the linear velocities of the inner ring and the outer ring of the brush are greatly different in such a manner, so that the effect of brushing burrs at roots and corners of a flange and a rim is often not expected.

SUMMARY OF THE INVENTION

The present application is aimed at providing an exchanging double-station wheel burr removing device, which can be used for simultaneously removing burrs on back cavities of two wheels and majorly removing burrs at roots and corners of flanges and rims.

In order to fulfill the above aim, the present application adopts the technical solution: an exchanging double-station wheel burr removing device comprises a frame, rollers, brackets, a drive motor, first cylinders, first guide posts, first guide sleeves, a left lifting plate, a rotary rack, a first bearing seat, a first shaft, a second shaft, a second bearing seat, a first gear ring, a first gear, a second gear, a third bearing seat, a third shaft, an outer ring brush, second cylinders, a bottom plate, first servo motors, left sliding plates, first guide rails, fourth bearing seats, fourth shafts, V-shaped rollers, racks, a round brush, an inner ring brush, third gears, fifth shafts, fifth bearing seats, right sliding plates, a second servo motor, a fourth gear, a second gear ring, a sixth bearing seat, a sixth shaft, a third servo motor, a turnover plate, a fourth servo motor, a large brush, a floating plate, springs, second guide posts, second guide sleeves, a support frame, a second guide rail, a first servo electric cylinder, a longitudinal sliding plate, a third guide rail, a second servo electric cylinder, a right lifting plate, third cylinders, third guide sleeves and third guide posts.

An exchange system comprises: the sixth bearing seat is fixed in the middle of the bottom of the frame; the sixth shaft is installed inside the sixth bearing seat via a bearing; the second gear ring is fixed above the outer side of the sixth bearing seat; the rotary rack is fixed at the top of the sixth shaft; the second servo motor is fixed above the rotary rack, and the fourth gear is fixed at the output end of the second servo motor; the fourth gear is engaged with the second gear ring; and the brackets are fixed at two ends of the rotary rack, and the rollers are installed below the brackets and are in contact with the bottom of the frame.

A left burr brushing system comprises: the two first cylinders are fixed below the rotary rack, and the output ends of the two first cylinders are articulated with the lower part of the left lifting plate; the four first guide sleeves are also fixed on the rotary rack, the four first guide posts matched with the four first guide sleeves, and are installed below the left lifting plate; the drive motor is installed below the left lifting plate; the first bearing seat is fixed above the left lifting plate; the first shaft is installed inside the first bearing seat via a bearing; the second bearing seat is also fixed above the left lifting plate, and arranged in the middle of the first bearing seat; the second shaft is installed inside the second bearing seat via a bearing; the first gear ring is fixed inside the first shaft; the second gear is fixed above the second shaft; the third bearing seat is fixed on a fixed plate inside the first shaft, and the third shaft is installed inside the third bearing seat via a bearing; the first gear is fixed below the third shaft, and the round brush is fixed above the third shaft; the first gear is simultaneously engaged with the first gear ring and the second gear; the outer ring brush is fixed at the top of the first shaft; and the inner ring brush is fixed at the top of the second shaft.

A clamping drive system comprises: the bottom plate is fixed on the frame; the left sliding plate is installed above the bottom plate via the first guide rail; the two fourth bearing seats are fixed above the left sliding plate; the fourth shafts are installed inside the fourth bearing seats via bearings; the first servo motor is fixed below the left sliding plate, and the output end of the first servo motor is connected with the lower ends of the fourth shafts; the V-shaped rollers are respectively fixed at the tops of the fourth shafts; the second cylinder is fixed on the side of the frame, and the output end of the second cylinder is connected with the left sliding plate; the right sliding plate is installed above the bottom plate via the first guide rail; the two fifth bearing seats are fixed above the right sliding plate; the V-shaped rollers are respectively installed at the tops of the two fifth shafts, and the two fifth shafts are installed inside the fifth bearing seats via bearings; a rack is respectively fixed below the left sliding plate and the right sliding plate; the third gear is fixed above the bottom plate; and the two racks are respectively engaged with the third gear. The device is composed of a left clamping drive system and a right clamping drive system.

A right burr brushing system comprises: the two third cylinders are fixed below the rotary rack, and the output ends of the two third cylinders are articulated with the lower part of the right lifting plate; the four guide third guide sleeves are fixed on the rotary rack, the four third guide posts matched with the third guide sleeves, and are fixed below the right lifting plate; the longitudinal sliding plate is fixed above the right lifting plate via the third guide rail; the first servo electric cylinder is fixed above the right lifting plate, and the output end of the first servo electric cylinder is connected with the longitudinal sliding plate; the bottom of the support frame is installed above the longitudinal sliding plate via the second guide rail; the second servo electric cylinder is fixed above the longitudinal sliding plate, and the output end of the second servo electric cylinder is connected with the side of the support frame; the four second guide sleeves are fixed above the support frame, and the four second guide posts matched with the second guide sleeves are fixed at the bottom of the floating plate; the springs are sleeved outside the second guide posts; the third servo motor is fixed on the side of a lug plate above the floating plate, and the output end of the third servo motor is connected with the lower part of the turnover plate; the fourth servo motor is fixed on the left side of the upper part of the turnover plate, and the large brush is installed at the output end of the fourth servo motor.

In practical use, the second cylinder drives the left sliding plate so that the four V-shaped rollers synchronously clamp a wheel via the third gear and the racks, the first servo motor drives the clamped wheel to rotate, and simultaneously, the right clamping drive system also enables a right wheel in a clamped state to rotate; the drive motor drives the second gear and the inner ring brush to rotate via the second shaft, and simultaneously drives the third shaft and the first shaft to rotate via the first gear and the first gear ring, thus driving the round brush and the outer ring brush to rotate; the first cylinders drive the rotating brushes to ascend via the first guide posts, and the brushes in contact with the back cavity of the wheel can remove burrs thereon; the first servo electric cylinder can drive the large brush to move front and back via the third guide rail, the second servo electric cylinder can drive the large brush to move left and right via the second guide rail, and the large brush can float via the springs and the second guide posts; the large brush can rotate an angle via the third servo motor and the turnover plate, and the fourth servo motor can drive the large brush to rotate; the third cylinders drive the large brush to ascend via the third guide posts, and when the large brush are in contact with roots and corners of wheel flanges and rims, it can remove burrs thereon; and the second servo motor can exchange the left burr brushing system with the right burr brushing system via the fourth gear and the second gear ring.

The exchanging double-station wheel burr removing device may be used for simultaneously removing burrs on back cavities of two wheels and majorly removing burrs at roots and corners of flanges and rims, and is very high in production efficiency, and simultaneously has the characteristics of high automation degree, advanced process, strong generality and high safety and stability.

Figure 1:
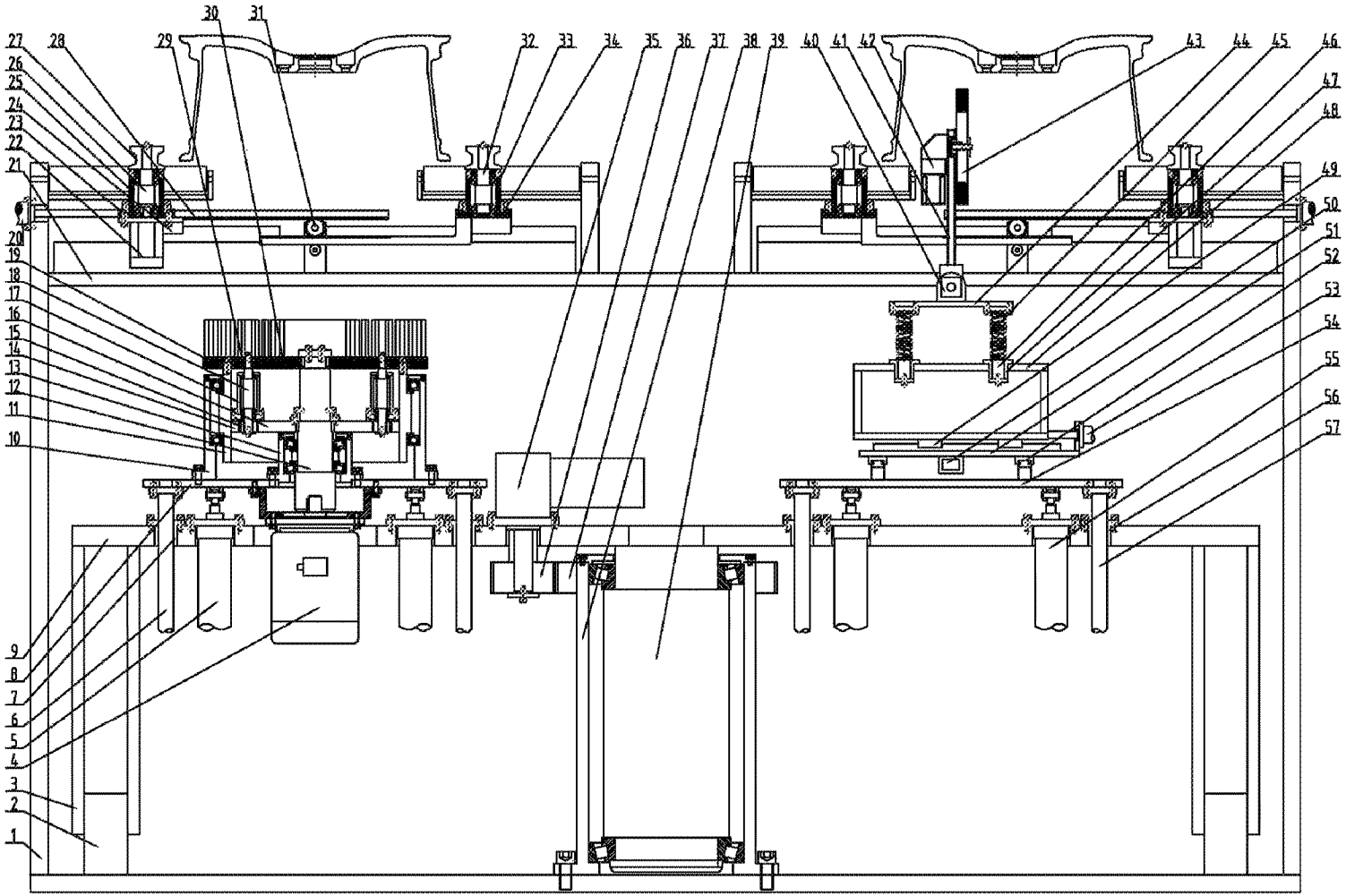
FIG. 1 is a front view of an exchanging double-station wheel burr removing device of the present application.
Figure 2:
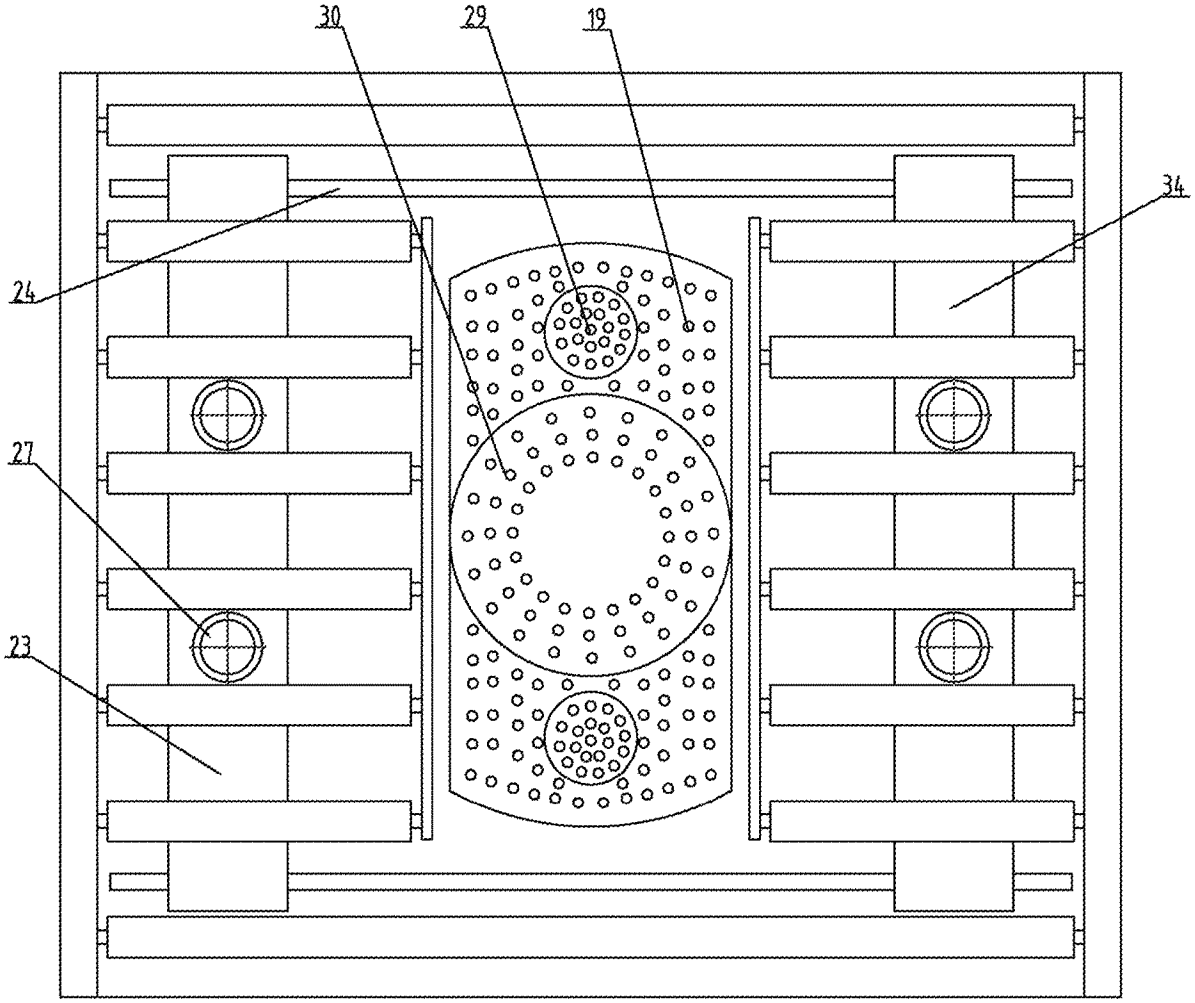
FIG. 2 is a partial top view of the exchanging double-station wheel burr removing device of the present application.
Figure 3:
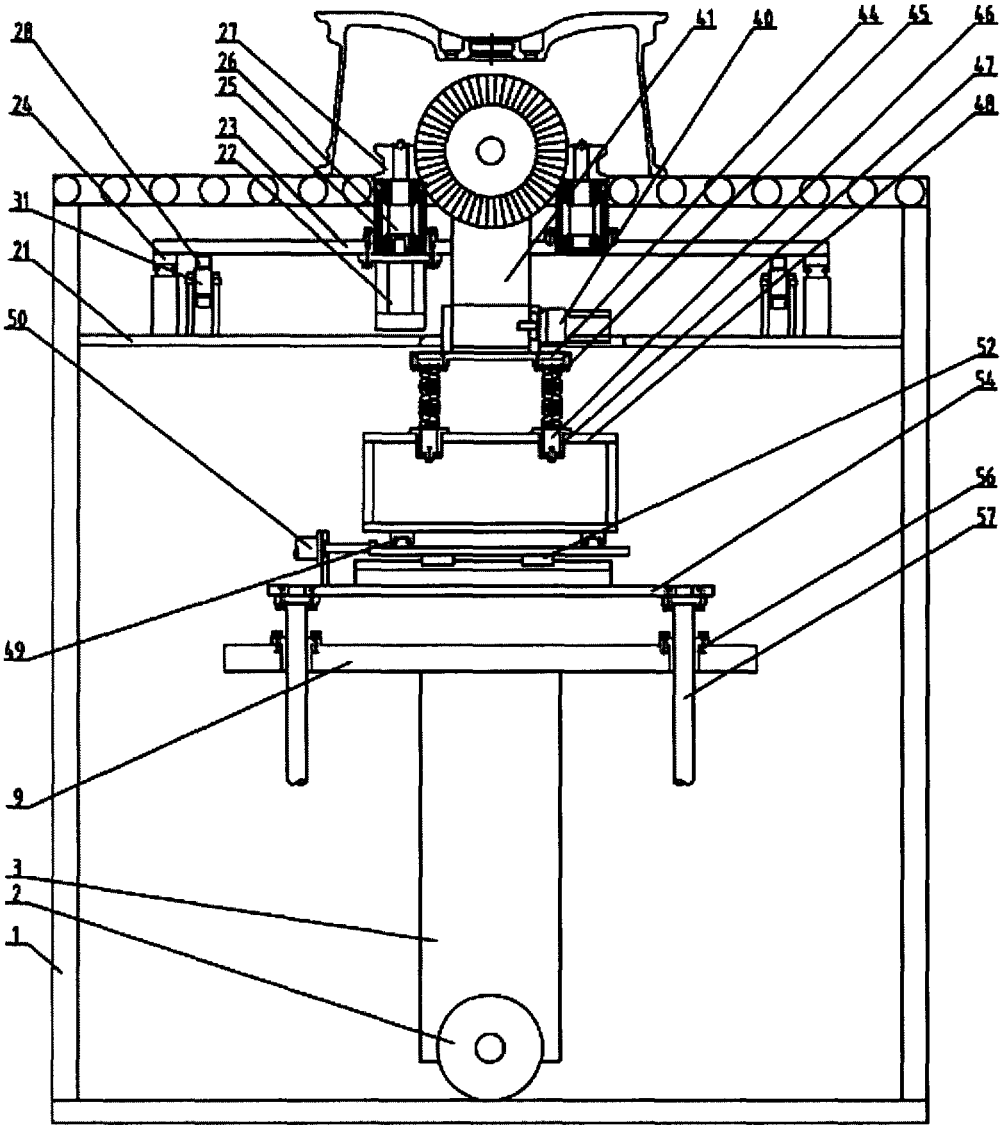
FIG. 3 is a right view of the exchanging double-station wheel burr removing device of the present application.

In which: 1—frame, 2—roller, 3—bracket, 4—drive motor, 5—first cylinder, 6—first guide post, 7—first guide sleeve, 8—left lifting plate, 9—rotary rack, 10—first bearing seat, 11—first shaft, 12—second shaft, 13—second bearing seat, 14—first gear ring, 15—first gear, 16—second gear, 17—third bearing seat, 18—third shaft, 19—outer ring brush, 20—second cylinder, 21—bottom plate, 22—first servo motor, 23—left sliding plate, 24—first guide rail, 25—fourth bearing seat, 26—fourth shaft, 27—V-shaped roller, 28—rack, 29—round brush, 30—inner ring brush, 31—third gear, 32—fifth shaft, 33—fifth bearing seat, 34—right sliding plate, 35—second servo motor, 36—fourth gear, 37—second gear ring, 38—sixth bearing seat, 39—sixth shaft, 40—third servo motor, 41—turnover plate, 42—fourth servo motor, 43—large brush, 44—floating plate, 45—spring, 46—second guide post, 47—second guide sleeve, 48—support frame, 49—second guide rail, 50—first servo electric cylinder, 51—longitudinal sliding plate, 52—third guide rail, 53—servo electric second servo electric cylinder, 54—right lifting plate, 55—third cylinder, 56—third guide sleeve, 57—third guide post.

DETAILED DESCRIPTION OF THE INVENTION

The details and working conditions of the specific device provided by the present application will be described below in combination with the accompanying drawings.

The device comprises a frame 1, rollers 2, brackets 3, a drive motor 4, first cylinders 5, first guide posts 6, first guide sleeves 7, a left lifting plate 8, a rotary rack 9, a first bearing seat 10, a first shaft 11, a second shaft 12, a second bearing seat 13, a first gear ring 14, a first gear 15, a second gear 16, a third bearing seat 17, a third shaft 18, an outer ring brush 19, second cylinders 20, a bottom plate 21, first servo motors 22, left sliding plates 23, first guide rails 24, fourth bearing seats 25, fourth shafts 26, V-shaped rollers 27, racks 28, a round brush 29, an inner ring brush 30, third gears 31, fifth shafts 32, fifth bearing seats 33, right sliding plates 34, a second servo motor 35, a fourth gear 36, a second gear ring 37, a sixth bearing seat 38, a sixth shaft 39, a third servo motor 40, a turnover plate 41, a fourth servo motor 12, a large brush 43, a floating plate 44, springs 45, second guide posts 46, second guide sleeves 47, a support frame 48, a second guide rail 49, a first servo electric cylinder 50, a longitudinal sliding plate 51, a third guide rail 52, a second servo electric cylinder 53, a right lifting plate 54, third cylinders 55, third guide sleeves 56 and third guide posts 57.

An exchange system comprises: the sixth bearing seat 38 is fixed in the middle of the bottom of the frame 1; the sixth shaft 39 is installed inside the sixth bearing seat 38 via a bearing; the second gear ring 37 is fixed above the outer side of the sixth bearing seat 38; the rotary rack 9 is fixed at the top of the sixth shaft 39; the second servo motor 35 is fixed above the rotary rack 9, and the fourth gear 36 is fixed at the output end of the second servo motor 35; the fourth gear 36 is engaged with the second gear ring 37; and the brackets 3 are fixed at two ends of the rotary rack 9, and the rollers 2 are installed below the brackets 3 and are in contact with the bottom of the frame 1.

A left burr brushing system comprises: the two first cylinders 5 are fixed below the rotary rack 9, and the output ends of the two first cylinders 5 are articulated with the lower part of the left lifting plate 8; the four first guide sleeves 7 are also fixed on the rotary rack 9, the four first guide posts 6 matched with the four first guide sleeves 7, and are installed below the left lifting plate 8; the drive motor 4 is installed below the left lifting plate 8; the first bearing seat 10 is fixed above the left lifting plate 8; the first shaft 11 is installed inside the first bearing seat 10 via a bearing; the second bearing seat 13 is also fixed above the left lifting plate 8, and arranged in the middle of the first bearing seat 10; the second shaft 12 is installed inside the second bearing seat 13 via a bearing; the first gear ring 14 is fixed inside the first shaft 11; the second gear 16 is fixed above the second shaft 12; the third bearing seat 17 is fixed on a fixed plate inside the first shaft 11, and the third shaft 18 is installed inside the third bearing seat 17 via a bearing; the first gear 15 is fixed below the third shaft 18, and the round brush 29 is fixed above the third shaft 18; the first gear 15 is simultaneously engaged with the first gear ring 14 and the second gear 16; the outer ring brush 19 is fixed at the top of the first shaft 11; and the inner ring brush 30 is fixed at the top of the second shaft 12.

A clamping drive system comprises: the bottom plate 21 is fixed on the frame 1; the left sliding plate 23 is installed above the bottom plate 21 via the first guide rail 24; the two fourth bearing seats 25 are fixed above the left sliding plate 23; the fourth shafts 26 are installed inside the fourth bearing seats 25 via bearings; the first servo motor 22 is fixed below the left sliding plate 23, and the output end of the first servo motor 22 is connected with the lower ends of the fourth shafts 26; the V-shaped rollers 27 are respectively fixed at the tops of the fourth shafts 26; the second cylinder 20 is fixed on the side of the frame 1, and the output end of the second cylinder 20 is connected with the left sliding plate 23; the right sliding plate 34 is installed above the bottom plate 21 via the first guide rail 24; the two fifth bearing seats 33 are fixed above the right sliding plate 34; the V-shaped rollers 27 are respectively installed are installed at the tops of the two fifth shafts, and the two fifth shafts inside the fifth bearing seats 33 via bearings; a rack 28 is respectively fixed below the left sliding plate 23 and the right sliding plate 34; the third gear 31 is fixed above the bottom plate 21; and the two racks 28 are respectively engaged with the third gear 31. The device comprises a left clamping drive system and a right clamping drive system.

A right burr brushing system comprises: the two third cylinders 55 are fixed below the rotary rack 9, and the output ends of the two third cylinders 55 are articulated with the lower part of the right lifting plate 54; the four third guide sleeves 56 are fixed on the rotary rack 9, the four third guide posts 57 are matched with the third guide sleeves 56, and are fixed below the right lifting plate 54; the longitudinal sliding plate 51 is fixed above the right lifting plate 54 via the third guide rail 52; the first servo electric cylinder 50 is fixed above the right lifting plate 54, and the output end of the first servo electric cylinder 50 is connected with the longitudinal sliding plate 51; the bottom of the support frame 48 is installed above the longitudinal sliding plate 51 via the second guide rail 49; the second servo electric cylinder 53 is fixed above the longitudinal sliding plate 51, and the output end of the second servo electric cylinder 53 is connected with the side of the support frame 48; the four second guide sleeves 47 are fixed above the support frame 48, and the four second guide posts 46 matched with the second guide sleeves 47 are fixed at the bottom of the floating plate 44; the springs 45 are sleeved outside the second guide posts 46; the third servo motor 40 is fixed on the side of a lug plate above the floating plate 44, and the output end of the third servo motor 40 is connected with the lower part of the turnover plate 41; the fourth servo motor 42 is fixed on the left side of the upper part of the turnover plate 41, and the large brush 43 is installed at the output end of the fourth servo motor 42.

In the working process, the second cylinder 20 drives the left sliding plate 23 so that the four V-shaped rollers 27 synchronously clamp a wheel via the third gear 31 and the racks 28, the first servo motor 22 drives the clamped wheel to rotate, and simultaneously, the right clamping drive system also enables a right wheel in a clamped state to rotate; the drive motor 4 drives the second gear 16 and the inner ring brush 30 to rotate via the second shaft 12, and simultaneously drives the third shaft 18 and the first shaft 11 to rotate via the first gear 15 and the first gear ring 14, thus driving the round brush 29 and the outer ring brush 19 to rotate; the first cylinders 5 drive the rotating brushes to ascend via the first guide posts 6, and the brushes in contact with the back cavity of the wheel can remove burrs; the first servo electric cylinder 50 can drive the large brush 43 to move front and back via the third guide rail 52, the second servo electric cylinder 53 can drive the large brush 43 to move left and right via the second guide rail 49, and the large brush 43 can float via the springs 45 and the second guide posts 46; the large brush 43 can rotate an angle via the third servo motor 40 and the turnover plate 41, and the fourth servo motor 42 can drive the large brush 43 to rotate; the third cylinders 55 drive the large brush 43 to ascend via the third guide posts 57, and when the large brush 43 are in contact with roots and corners of wheel flanges and rims, it can remove burrs thereon; and the second servo motor 35 can exchange the left burr brushing system with the right burr brushing system via the fourth gear 36 and the second gear ring 37.

The foregoing descriptions of specific exemplary embodiments of the present application have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present application, as well as various alternatives and modifications thereof. It is intended that the scope of the invention be defined by the Claims appended hereto and their equivalents.

What is claimed is:

1. An exchanging double-station wheel burr removing device comprising a frame, rollers, brackets, a drive motor, first cylinders, first guide posts, first guide sleeves, a left lifting plate, a rotary rack, a first bearing seat, a first shaft, a second shaft, a second bearing seat, a first gear ring, a first gear, a second gear, a third bearing seat, a third shaft, an outer ring brush, second cylinders, a bottom plate, first servo motors, left sliding plates, first guide rails, fourth bearing seats, fourth shafts, V-shaped rollers, racks, a round brush, an inner ring brush, third gears, fifth shafts, fifth bearing seats, right sliding plates, a second servo motor, a fourth gear, a second gear ring, a sixth bearing seat, a sixth shaft, a third servo motor, a turnover plate, a fourth servo motor, a large brush, a floating plate, springs, second guide posts, second guide sleeves, a support frame, a second guide rail, a first servo electric cylinder, a longitudinal sliding plate, a third guide rail, a second servo electric cylinder, a right lifting plate, third cylinders, aide third guide sleeves and third guide posts, wherein an exchange system comprises: the sixth bearing seat is fixed in the middle of the bottom of the frame; the sixth shaft is installed inside the sixth bearing seat via a bearing; the second gear ring is fixed above the outer side of the sixth bearing seat; the rotary rack is fixed at the top of the sixth shaft; the second servo motor is fixed above the rotary rack, and the fourth gear is fixed at the output end of the second servo motor; the fourth gear is engaged with the second gear ring; and the brackets are fixed at two ends of the rotary rack, and the rollers are installed below the brackets and are in contact with the bottom of the frame;

a left burr brushing system comprises: the two first cylinders are fixed below the rotary rack, and the output ends of the two first cylinders are articulated with the lower part of the left lifting plate; the four first guide sleeves are also fixed on the rotary rack, the four first guide posts matched with the four first guide sleeves, and are installed below the left lifting plate; the drive motor is installed below the left lifting plate; the first bearing seat is fixed above the left lifting plate; the first shaft is installed inside the first bearing seat via a bearing; the second bearing seat is also fixed above the left lifting plate, and arranged in the middle of the first bearing seat; the second shaft is installed inside the second bearing seat via a bearing; the first gear ring is fixed inside the first shaft; the second gear is fixed above the second shaft; the third bearing seat is fixed on a fixed plate inside the first shaft, and the third shaft is installed inside the third bearing seat via a bearing; the first gear is fixed below the third shaft, and the round brush is fixed above the third shaft; the first gear is simultaneously engaged with the first gear ring and the second gear; the outer ring brush is fixed at the top of the first shaft; the inner ring brush is fixed at the top of the second shaft;

a clamping drive system comprises: the bottom plate is fixed on the frame; the left sliding plate is installed above the bottom plate via the first guide rail; the two fourth bearing seats are fixed above the left sliding plate; the fourth shafts are installed inside the fourth bearing seats via bearings; the first servo motor is fixed below the left sliding plate, and the output end of the first servo motor is connected with the lower ends of the fourth shafts; the V-shaped rollers are respectively fixed at the tops of the fourth shafts; the second cylinder is fixed on the side of the frame, and the output end of the second cylinder is connected with the left sliding plate; the right sliding plate is installed above the bottom plate via the first guide rail; the two fifth bearing seats are fixed above the right sliding plate; the V-shaped rollers are respectively installed at the tops of the two fifth shafts, and the two fifth shafts are installed inside the fifth bearing seats via bearings; a rack is respectively fixed below the left sliding plate and the right sliding plate; the third gear is fixed above the bottom plate; the two racks are respectively engaged with the third gear; the device is composed of a left clamping drive system and a right clamping drive system;

a right burr brushing system comprises: the two third cylinders are fixed below the rotary rack, and the output ends of the two third cylinders are articulated with the lower part of the right lifting plate; the four third guide sleeves are fixed on the rotary rack, the four third guide posts are matched with the third guide sleeves, and are fixed below the right lifting plate; the longitudinal sliding plate is fixed above the right lifting plate via the third guide rail; the first servo electric cylinder is fixed above the right lifting plate, and the output end of the first servo electric cylinder is connected with the longitudinal sliding plate; the bottom of the support frame is installed above the longitudinal sliding plate via the second guide rail; the second servo electric cylinder is fixed above the longitudinal sliding plate, and the output end of the servo electric second servo electric cylinder is connected with the side of the support frame; the four second guide sleeves are fixed above the support frame, and the four second guide posts matched with the second guide sleeves are fixed at the bottom of the floating plate; the springs are sleeved outside the second guide posts; the third servo motor is fixed on the side of a lug plate above the floating plate, and the output end of the third servo motor is connected with the lower part of the turnover plate; the servo fourth servo motor is fixed on the left side of the upper part of the turnover plate, and the large brush is installed at the output end of the fourth servo motor;

in practical use, the second cylinder drives the left sliding plate so that the four V-shaped rollers synchronously clamp a wheel via the third gear and the racks, the first servo motor drives the clamped wheel to rotate, and simultaneously, the right clamping drive system also enables a right wheel in a clamped state to rotate; the drive motor drives the second gear and the inner ring brush to rotate via the second shaft, and simultaneously drives the third shaft and the first shaft to rotate via the first gear and the first gear ring, thus driving the round brush and the outer ring brush to rotate; the first cylinders drive the rotating brushes to ascend via the first guide posts, and the brushes in contact with the back cavity of the wheel can remove burrs thereon; the first servo electric cylinder can drive the large brush to move front and back via the third guide rail, the second servo electric cylinder can drive the large brush to move left and right via the second guide rail, and the large brush can float via the springs and the second guide posts; the large brush can rotate an angle via the third servo motor and the turnover plate, and the fourth servo motor can drive the large brush to rotate; the third cylinders drive the large brush to ascend via the third guide posts, and when the large brush are in contact with roots and corners of wheel flanges and rims, it can remove burrs thereon; and the second servo motor can exchange the left burr brushing system with the right burr brushing system via the fourth gear and the second gear ring.

* * * * *